US007838121B1

(12) United States Patent
Sambasivan et al.

(10) Patent No.: US 7,838,121 B1
(45) Date of Patent: Nov. 23, 2010

(54) HIGHLY ANISOTROPIC CERAMIC THERMAL BARRIER COATING MATERIALS AND RELATED COMPOSITES

(75) Inventors: Sankar Sambasivan, Chicago, IL (US); Kimberly Steiner, Chicago, IL (US)

(73) Assignee: Applied Thin Films, Inc., Evanston, IL (US)

( * ) Notice: Subject to any disclaimer, the term of this patent is extended or adjusted under 35 U.S.C. 154(b) by 0 days.

(21) Appl. No.: 12/410,080

(22) Filed: Mar. 24, 2009

Related U.S. Application Data

(60) Continuation of application No. 11/504,163, filed on Aug. 15, 2006, now Pat. No. 7,507,288, which is a continuation of application No. 10/761,021, filed on Jan. 20, 2004, now Pat. No. 7,090,723, which is a division of application No. 09/845,097, filed on Apr. 27, 2001, now Pat. No. 6,680,126.

(60) Provisional application No. 60/200,051, filed on Apr. 27, 2000.

(51) Int. Cl.
*B32B 9/00* (2006.01)

(52) U.S. Cl. ..... 428/471; 428/469; 428/689; 428/697; 428/699; 428/702; 501/137; 117/3

(58) Field of Classification Search ..... 428/469, 428/471, 689, 697, 699, 702; 501/137; 117/3
See application file for complete search history.

(56) References Cited

U.S. PATENT DOCUMENTS 4,757,037 A * 7/1988 Colombet et al. ..... 501/134
5,026,945 A 6/1991 Campbell
5,137,852 A 8/1992 Morgan
5,209,860 A 5/1993 Trivett
5,238,673 A 8/1993 Bruno et al.
5,442,585 A 8/1995 Eguchi et al.
5,470,668 A 11/1995 Wu et al.
5,665,463 A 9/1997 Morgan
5,713,895 A 2/1998 Loutine et al.
6,231,991 B1 5/2001 Maloney
6,261,643 B1 7/2001 Hasz et al.
6,284,323 B1 9/2001 Maloney
6,319,614 B1 11/2001 Beele
6,382,920 B1 5/2002 Dopper
6,387,526 B1 5/2002 Beele (Continued)

FOREIGN PATENT DOCUMENTS

JP 06279098 10/1994

OTHER PUBLICATIONS

Ravichandran, K., An, K., Dutton, R., and Semiatin, S.L. Thermal Conductivity of Plasma-Sprayed Monolithic and Multilayer Coatings of Alumina and Yttria-Stabilized Zirconia, Journal of the American Ceramic Society, vol. 82, No. 3, Mar. 1999, pp. 673-682.

(Continued)

*Primary Examiner*—Robert M Kunemund
*Assistant Examiner*—Matthew J Song
(74) *Attorney, Agent, or Firm*—Reinhart Boerner Van Deuren s.c.

(57) ABSTRACT

High temperature composites and thermal barrier coatings, and related methods, using anisotropic ceramic materials, such materials as can be modified to reduce substrate thermal mismatch.

5 Claims, 13 Drawing Sheets

U.S. PATENT DOCUMENTS

| | | | | |
|---|---|---|---|---|
| 6,387,539 | B1 | 5/2002 | Subramanian | |
| 6,424,316 | B1 | 7/2002 | Leisten | |
| 6,482,476 | B1 | 11/2002 | Liu | |
| 6,500,489 | B1 | 12/2002 | Hintermaier et al. | |
| 6,680,126 | B1 * | 1/2004 | Sambasivan et al. | 428/471 |
| 7,090,723 | B2 | 8/2006 | Sambasivan et al. | |
| 2001/0007719 | A1 | 7/2001 | Maloney | |
| 2002/0061416 | A1 | 5/2002 | Subramanian | |
| 2002/0172837 | A1 | 11/2002 | Allen et al. | |

OTHER PUBLICATIONS

Klemens, P.G. and Gell, M. Thermal Conductivity of Thermal Barrier Coatings, Materials Science & Engineering, A245 (1998) pp. 143-149, Elsevier Science S.A. 1998.

Fair, G., Shemkunas, M., Petuskey, W. and Sambasivan, S. Layered Perovskites as 'Soft-Ceramics', Journal of the European Ceramic Society, 1999, pp. 2437-2447, Elsevier Science Ltd., Great Britain, 1999, vol. 19.

Steiner, K.A.; Thermal Expansion and Compressibility of Layered Perovskite Compounds; M.S. Thesis, Arizona State Univeristy, 1998.

* cited by examiner

HIGHLY ANISOTROPIC CERAMIC THERMAL BARRIER COATING MATERIALS AND RELATED COMPOSITES

The present invention is a continuation of and claims priority benefit from application Ser. No. 11/504,163 filed on Aug. 15, 2006, and issued as U.S. Pat. No. 7,507,288 on Mar. 24, 2009, which was a continuation of Ser. No. 10/761,021 filed on Jan. 20, 2004, and issued as U.S. Pat. No. 7,090,723 on Aug. 15, 2006, which was a divisional of application Ser. No. 09/845,097 filed on Apr. 27, 2001, issued as U.S. Pat. No. 6,680,126 on Jan. 20, 2004, which in turn claims the benefit of prior provisional application No. 60/200,051, filed Apr. 27, 2000, each of which is incorporated herein by reference in its entirety.

BACKGROUND OF THE INVENTION

High temperature conditions impose unique material requirements. For instance, turbine engine components used in aerospace and equipment used in various energy-related fields require thermal barriers to reduce induction of heat to the metal component/equipment. Application of ceramic-based thermal barrier coatings (TBCs) to a metal/alloy substrate can facilitate use and operation at higher temperatures. However, degradation of TBCs at elevated temperatures, under thermal cycling conditions and in erosive or corrosive environments has raised concerns about the durability and reliability of such materials during use and over extended time. Spallation of ceramic-based TBCs during thermo-mechanical loading and thermal cycling has been, and remains, a key problem facing the art, particularly in the turbine industry.

Currently, the coating material most often used is yttria-stabilized zirconia (YSZ). YSZ has demonstrated adequate resistance to thermal conduction, but suffers from many drawbacks including poor phase and micro-structure stability and creep resistance, as well as high oxygen diffusivity at even moderately high temperatures. Induced stress caused by creep and bond-coat oxidation results in spallation of the YSZ coating. Accordingly, the search for alternate ceramic compositions that satisfy all the thermal, chemical, and thermo-mechanical requirements continues to be an on-going concern in the art.

SUMMARY OF THE INVENTION

Figure 1:
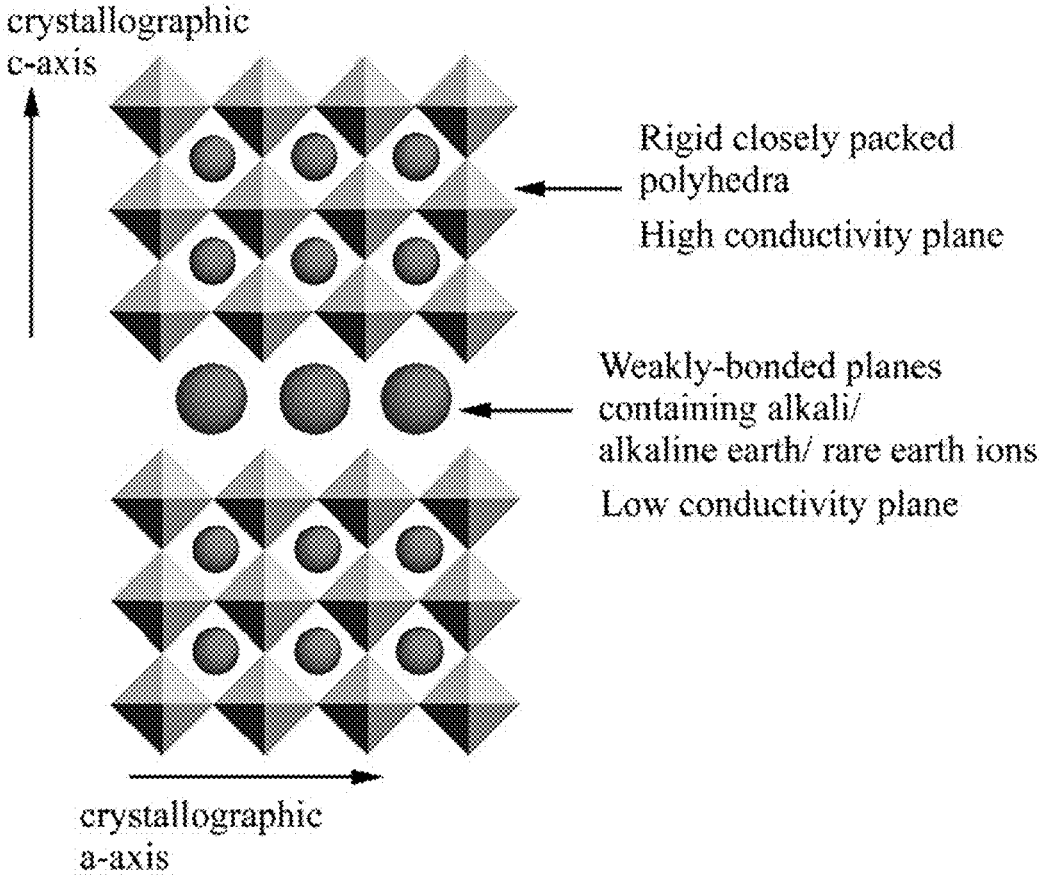
FIG. 1 is a schematic representation illustrating oxide blocks and interlayers associated with the ceramic materials of this invention.

In light of the foregoing, it is an object of the present invention to provide new ceramic thermal barrier coating materials and/or compositions, together with metallic substrates and methods used therewith, thereby overcoming various deficiencies and shortcomings of the prior art, including those outlined above. It will be understood skilled in the art that one or more aspects of this invention can meet certain objectives, while one or more other aspects can meet certain other objectives. Each objective may not apply equally, in all its respects, to every aspect of this invention. As such, the following objects can be viewed in the alternative with respect to any one aspect of this invention.

It is an object of the present invention to provide highly anisotropic crystalline ceramic materials/compositions having reduced thermal conductivity while providing improved mechanical stability, such materials/compositions as can be applied to various metallic substrates for use or operation in high temperature environments.

It can also be an object of the present invention to provide one or more such ceramic materials which can be altered in terms of either texture, crystalline structure and/or chemical composition to further reduce thermal conductivity and/or affect thermal expansion.

It can also be an object of the present invention, through use of the crystalline ceramic materials described herein to tailor the thermal expansion properties thereof through crystallographic texture/orientations to match the thermal expansion properties of a substrate used therewith, so as to reduce or minimize residual stress otherwise induced by thermal mismatch.

Accordingly, through matching of thermal expansions and minimizing thermal stress, it can also be an object of the present invention to provide thermal barrier coatings of greater thickness dimension than otherwise possible through the prior art, such thicker coatings thereby further reducing high temperature impact.

Other objects, features, benefits and advantages of the present invention will be apparent from this summary and its descriptions of various preferred embodiments, and will be readily apparent to those skilled in the art having knowledge of various thermal barrier coatings, associated composites and assembly/production techniques. Such objects, features, benefits and advantages will be apparent from the above as taken in conjunction with the accompanying examples, data, figures and all reasonable inferences to be drawn therefrom.

This invention relates to the use of new compounds and/or materials for TBC applications. The high temperature ceramic materials described, herein, have low thermal conductivities and can be used as coatings on turbine blades and other metallic components protection from failure during exposure to elevated temperatures (typically above 1200° C.). One novel aspect of this invention relates to the discovery and appreciation of atomistic barriers to heat conduction in highly anisotropic ceramic materials. In addition, a high degree of anisotropy in thermal expansion allows for design of coatings with minimal residual stresses through the development of appropriate texture in the coating. Preliminary results obtained on bulk samples of anisotropic crystalline $BaNd_2Ti_3O_{10}$ showed that such materials can exhibit stability and low thermal conductivity over a wide range of temperatures (RT to 1400° C.).

More particularly, this invention relates to use of layered oxide materials with a high degree of crystalline anisotropy, such as but not necessarily limited to layered perovskites or layered spinels. Layered perovskites are known materials, previously of interest with regard to their electrical properties. The present invention, however, hereby provides such layered crystalline materials for use in thermal protective applications and/or as otherwise described herein. For purposes of illustration, consider layered perovskites. Such materials have structures similar to graphite: Layers of atomic planes with strong ionic in-plane bonds, but with weak bonds across the planes. Specifically, these materials comprise strong, flexible perovskite slabs separated by layers of alkali, alkaline earth and/or rare earth element atoms. A highly anisotropic crystalline structure is believed to provide the anisotropic properties utilized in the context of this invention. (See, FIG. 1.)

Without limitation to any one theory or mode of operation, the weakly-bonded planes that exist between planes containing rigid polyhedra in layered oxides can act as barriers to phonon conduction resulting in lowering of material thermal conductivity. Such disorder (or subsequent disruption) decreases the mean free path for phonon conduction and can be used to lower thermal conductivity.

The prior art attempted to achieve such results on a much "coarser" multi-phase scale, through the use of many alternate separate ordered layers of alumina and zirconia where the interfaces between the layers could act as barriers to phonon conduction. Even so, the protective effect of this approach has not been shown significant. In contrast, the present invention achieves improved results through a single phase crystalline approach, utilizing anisotropic interlayer structure and disorder on a nanometric scale.

In part, the present invention is a composite including a metallic substrate and a crystalline ceramic material on the substrate. The ceramic material has crystalline anisotropy with a plurality of packed or closely packed oxide blocks, each oxide block separated by an interlayer plane of alkali, alkaline earth and/or rare earth ions. The ceramic material of the inventive composite can have a crystalline structure consistent with the foregoing. In preferred embodiments, such material can have a layered perovskite structure or a layered spinel structure.

The layered perovskites useful in conjunction with the present invention include those structures currently known and as have been used in unrelated contexts, such as mechanically protective boundary phases for ceramic matrix composites. Such layered perovskite structures are described in "Synthesis and Reaction Chemistry of Layered Oxides with Perovskite-Related Structures", Chemical Physics of Intercalation II, Jacobsen, Plenum Press, New York, 1993, pp. 117-139, Vol. 305, NATO Advanced Science Institute Series, Series B, the entirety of which is incorporated herein by reference.

More particularly, as present in preferred metallic composites of this invention, the crystalline ceramic material is a titanate perovskite having a compositional formula $AB_{n-1}Ti_nO_{3n+1}$. Without limitation, one such titanate is barium neodymium titanate, $BaNd_2Ti_3O_{10}$, known by the acronym BNT. Various other perovskite titanates are known and can be used with the present invention. Theoretically, other such titanate ceramic materials are possible, but have not yet been isolated or synthesized. Such materials are also contemplated within the broader context of this invention.

Alternatively, the ceramic material of this invention is a niobate perovskite having a compositional formula $AB_{n-1}Nb_nO_{3n+1}$. Numerous such niobate compounds can be used, including but not limited to potassium calcium niobate, $KCa_2Nb_3O_{10}$, and potassium lanthanum niobate, $KLaNb_2O_7$, referred to by the acronyms KCN and KLN, respectively. Likewise, various other perovskite niobates are theoretically possible, but have not yet been isolated or synthesized. Such compounds are also contemplated within the broader context of this invention, equivalent to those crystalline titanate or niobate ceramic materials more specifically identified herein as used with the composites and/or methods described herein.

The substrates of the inventive composites comprise those metallic materials having, or as can be shown to have, high temperature applications. To that effect, the metallic substrate of this invention can be but is not limited to nickel, chromium, steel, yttrium and/or alloys thereof.

In part, the present invention includes a method of using the effect of temperature on a crystalline ceramic material to reduce its thermal conductivity. Such a method includes (1) providing a ceramic material having a layered crystalline morphology and orientation, and (2) heating the material at a temperature sufficient to alter the crystalline orientation of the material. As described and illustrated more fully below, such heating can be achieved by annealing the ceramic material at a suitable temperature. Alternatively, the temperature change associated with such a method can be effected through application of such a material to a substrate by a plasma spray technique, whereby material melting and/or re-crystallization over a temperature range can alter crystalline and/or interphase structure and reduce thermal conductivity.

In part, the present invention can also include a method of using the texture of a ceramic material to affect the thermal conductivity of a ceramic material. Such a method includes (1) providing an anisotropic crystalline ceramic material, the material including a plurality of layered basal planes, and having a first crystallographic texture; and (2) treating the ceramic material to provide a second crystallographic texture. Such treatment is believed to introduce material stress and can be provided thermally, although other techniques could be utilized to alter and/or further disrupt crystallographic morphology. Even so, preferred embodiments of this method include annealing the ceramic material to induce a second crystallographic texture and thereby affect the thermal conductivity thereof. As would be understood by those in the art, as a level of porosity is introduced by such a material, the thermal conductivity can be reduced even further.

The low k values associated with the materials of this invention can also be attributed to the compliant nature of basal planes that bend to accommodate stresses which in turn induces atomic disorder resulting in further decrease in thermal conductivity. For instance, TEM analysis of the hot pressed BNT showed many grains that were bent at right angles displaying significant disorder. Accordingly, due to the soft nature of these layered oxides, it may be necessary to provide a two phase system, such as alumina and BNT, such that some hardness and strength is imparted to the TBC system while maintaining a lower thermal conductivity. Regardless, whether a single or two phase system, the composites of this invention, coatings of layered oxides on metallic substrates, can be made from either solution deposition or plasma spray of powders on to the substrate. For instance, potassium calcium niobate coatings have been made by both methods.

EXAMPLES OF THE INVENTION

The following non-limiting examples and data illustrate various aspects and features relating to the materials/composites and/or methods of the present invention, including the anisotropic ceramic materials having various chemical compositions and/or crystalline structures, either currently available or as could be synthesized by straight-forward modifications of techniques known to those skilled in the art. In comparison with the prior art, the present materials, composites and/or methods provide results and data which are surprising, unexpected and contrary thereto. While the utility of this invention is illustrated through the use of various materials/composites and/or chemical compositions, it will be understood by those skilled in the art that comparable results are obtainable with various other materials/composites and/or methods, as are commensurate with the scope of this invention.

Example 1

As mentioned above, highly anisotropic crystal structure leads to anisotropic properties. Fracture in these materials is characterized by inter-basal splitting resulting in delamination. This anisotropy is demonstrated or evidenced in fracture and illustrated by the indentation patterns in $KCa_2Nb_3O_{10}$ (KCN) (FIG. 2). The damage shown in FIG. 2 corresponds to a relatively light load of 0.25 N. While for most brittle and isotropic ceramics, indentation damage appears as cracks radiating out from the corners of the indent, considerable fracture damage in KCN is observed in the basal planes. In layered perovskites, inter-basal splitting predominates over trans-basal layer fracture. It should be noted that thermal stresses induced in the material during high temperature treatment may cause interbasal splitting resulting in formation of "nanocracks" which may be beneficial in further lowering the thermal conductivity.

The use of highly anisotropic materials offers the ability to introduce "nanolayered" disorder at the atomic scale. In addition, these layered oxides also exhibit a high degree of anisotropy in thermal expansion. For example, potassium calcium niobate ($KCa_2Nb_3O_{10}$), a layered perovskite, has a coefficient of thermal expansion (CTE) value of $7.10^{-066}$/K in the a-direction and $20.10^{-07}$/K in the c-direction. Such properties of the TBCs of this invention, can be altered to minimize thermal stress by modification of material texture.

Example 2

Figure 3:
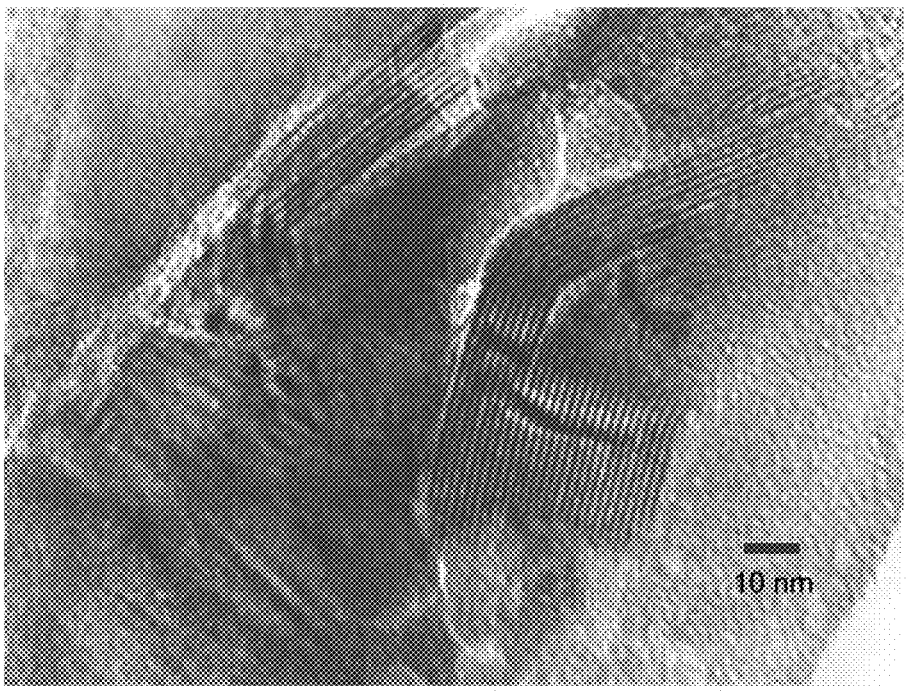
FIG. 3 is a cross-sectional TEM micrograph of hot pressed $BaNd_2Ti_3O_{10}$, (BNT) which shows the turbostratic and compliant nature of the material.

The high degree of compliance in these TBC materials can be best demonstrated by a TEM image. A cross-section TEM observation of $BaNd_2Ti_3O_{10}$ (BNT) (another layered perovskite) shows the turbostratic nature of layered perovskites (FIG. 3), much like graphite or h-BN. TEM observations also revealed the ability for blocks of perovskite layers to bend into rather sharp curvatures, which could only be accommodated with a cooperative process of inter basal slipping. Such compliance and facile texture induction can be utilized, as described herein, to affect thermal conductivity and thermal expansion, ultimately to minimize thermal mismatch between the substrate and ceramic materials of this invention.

Example 3

Figure 4A:
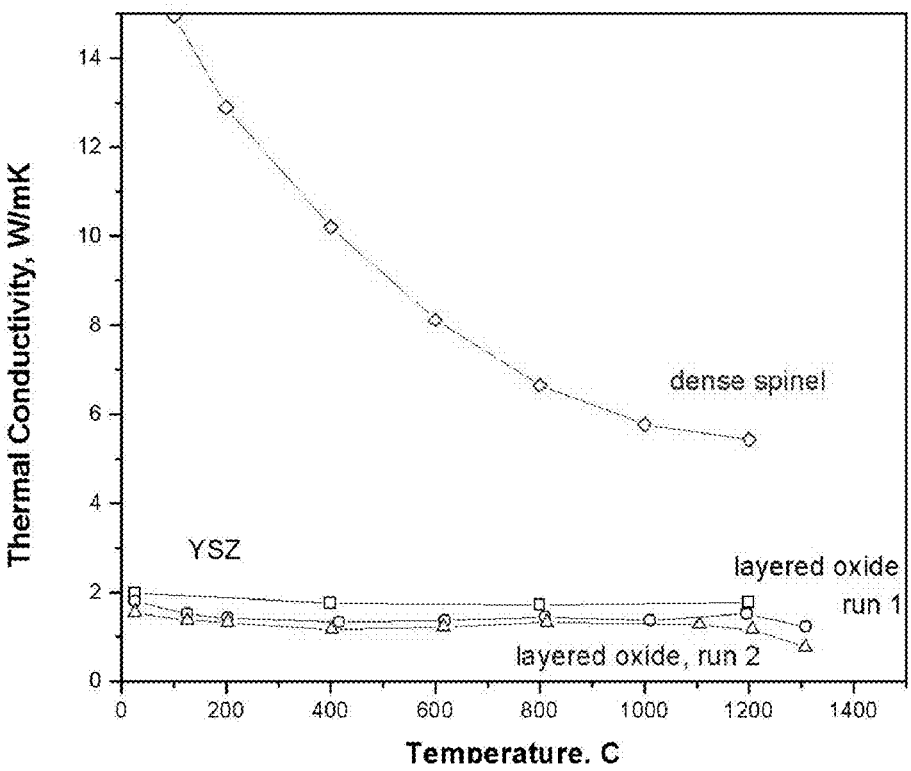
FIG. 4*a* plots, graphically, the thermal conductivity behavior of BNT in comparison with YSZ and Spinel (BNT marked as Layered Oxide)—(Thermal diffusivity and heat capacity were measured to compute thermal conductivity)
Figure 4B:
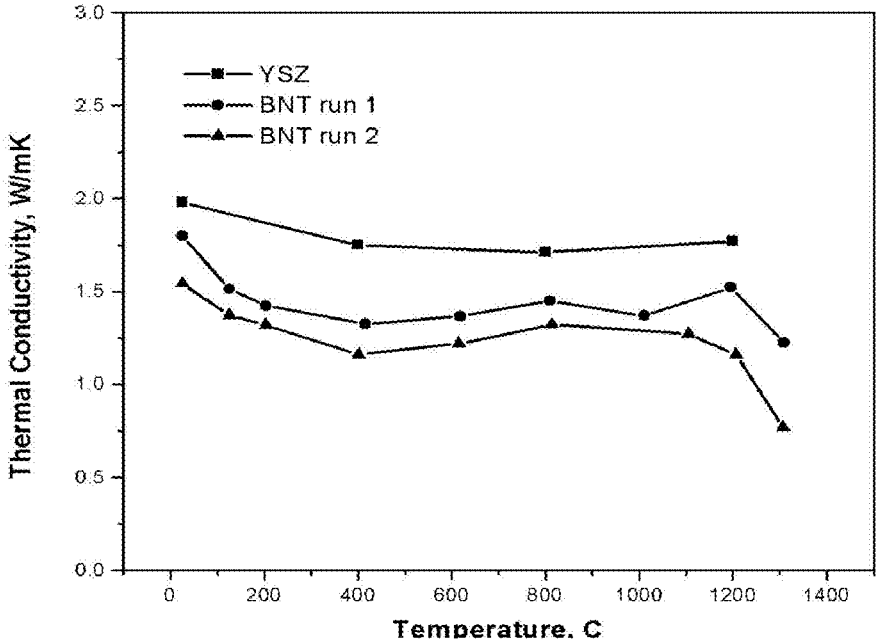
FIG. 4*b* provides the same relationships on a different scale, to better illustrate additional decrease in thermal conductivity with heating beyond 1200° C.
Figure 5B:
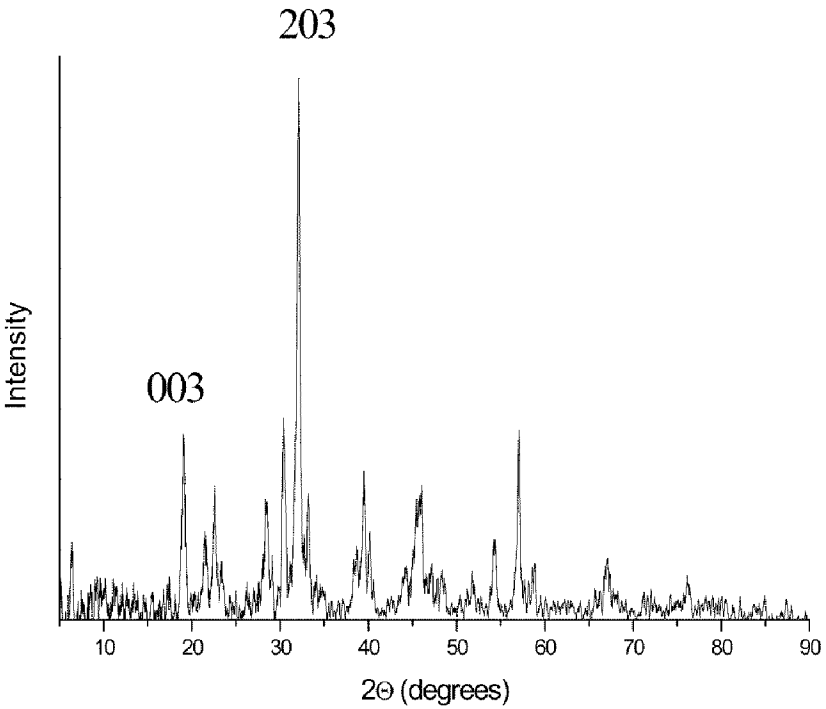
FIG. 5*b* shows the same BNT specimen after annealing for thermal conductivity measurements.
Figure 5A:
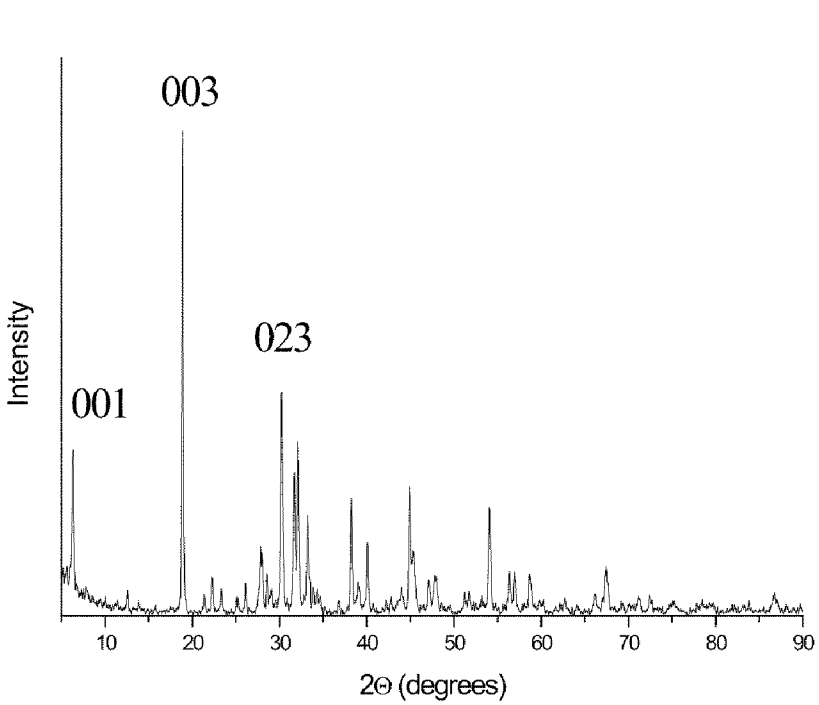
FIG. 5*a* shows an XRD pattern of BNT as hot pressed.

FIGS. 4*a* and 4*b* show behavior of 2 runs conducted using separate sections of the hot pressed BNT samples (each data point in the curve collected after 15 minute exposure at temperature). Both runs are very consistent and show a slight decrease in the conductivity beyond 1200° C. The lowest conductivity value of ~0.7 W/m.K was achieved at 1300° C. It is worth noting that these low values represent fully densified materials (>99% density). The as-hot pressed samples showed a highly textured material with the basal planes oriented perpendicular to the hot pressing direction (typical of highly anisotropic materials). However, after the conductivity test at high temperatures, the x-ray diffraction (XRD) analysis did show some texture rearrangement (FIGS. 5*a* and 5*b*). The consistent decrease in conductivity value for both runs beyond 1200° C. suggests that further disordering or disruption of basal plane morphology is taking place due to thermal stresses induced at high temperatures and that further lowering of thermal conductivity can be achieved.

As observed through consideration of FIGS. 4-5, it is surprising that highly aligned basal texture is not necessary to obtain satisfactory low k values, suggesting that phonon scattering is efficient even in randomly oriented grains or textures. This aspect of the present invention presents the prospect for using the highly anisotropic materials and tailoring the CTE thereof to obtain a thermal match with the substrate. By controlling a crystallographic texture/orientations of a deposited coating, a desired CTE value may be obtained. Residual stress induced by thermal mismatch between coating and the substrate is a significant factor in the debonding and cracking of such coatings. Reducing the thermal mismatch stress can greatly reduce this driving force for mechanical failure. As reasonably implied to those skilled in the art, the XRD data of FIGS. 5*a* and 5*b* demonstrates the efficacy of tailoring thermal expansion through modification of texture content (a- versus c-oriented) so as to minimize substrate/coating thermal mismatch and resultant stress.

Example 4

Figure 2A:
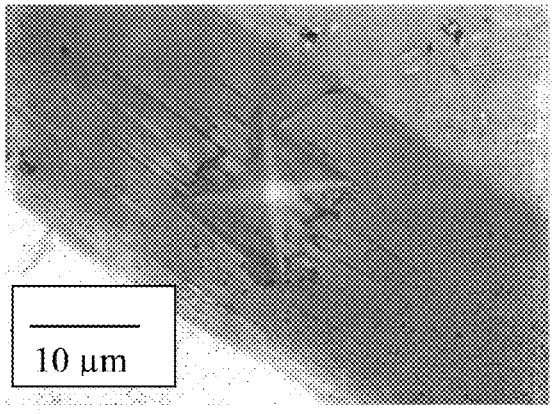
FIG. 2 shows Vickers microindentation pattern of hot-pressed $KCa_2Nb_3O_{10}$(KCN) under 0.25 N load with the indenter 45° tilted against (a) and parallel to (b) the c-axis.
Figure 2B:
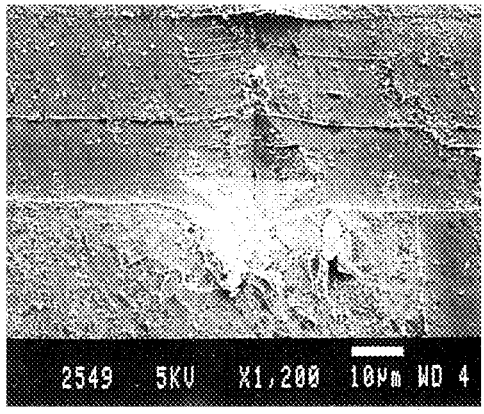
Figure 6:
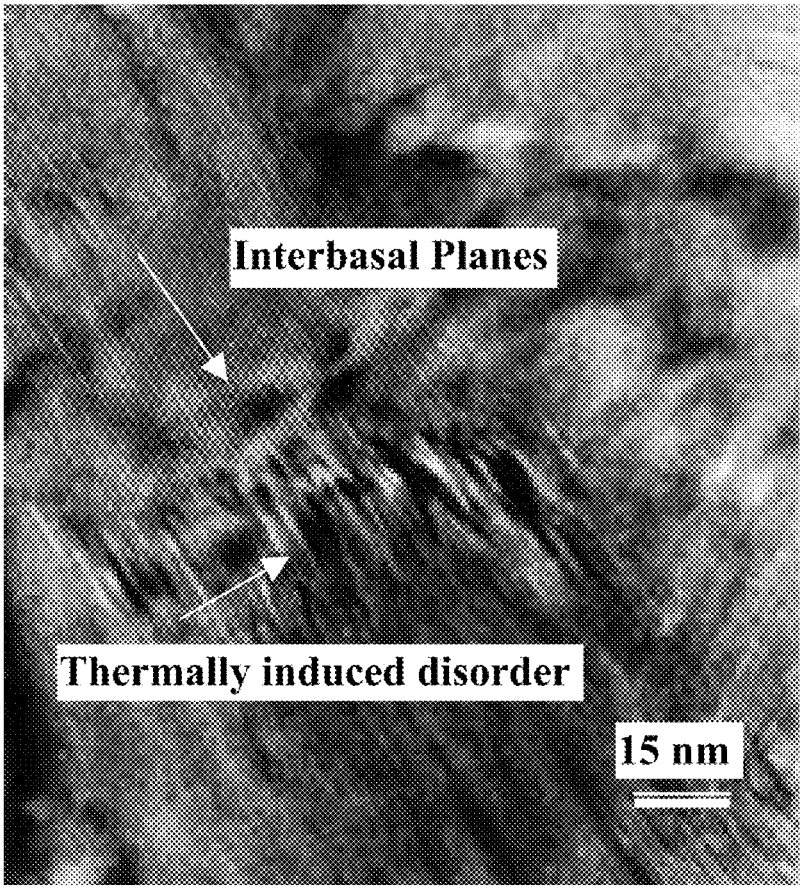
FIG. 6 provides a TEM image of a BNT grain subjected to thermal stress.

The TEM micrograph in FIG. 6 illustrates the disorder induced in a thermally treated material where the interbasal planes appear to be severely distorted. This observation along with the high degree of compliance (demonstrated by the mechanical behavior; FIGS. 2*a* and 2*b*) demonstrates the use of the ceramic materials of this invention as TBCs.

Example 5

As provided through the data and results of the preceding example, the ceramic materials/compositions of this invention can be used to reduce substrate/coating thermal mismatch. Ultimately, the advantage of using highly anisotropic materials, in general, lies in the possibility of tailoring the CTE to obtain a best thermal match with the substrate. By controlling the crystallographic texture/orientations of the deposited coating, a desired CTE value may be obtained. It has been known that the residual stress induced by thermal mismatch between coating and substrate is a major cause of debonding and cracking in ceramic coatings. Reducing the thermal mismatch stress can greatly reduce the driving force for mechanical failure.

Example 6

Figure 7:
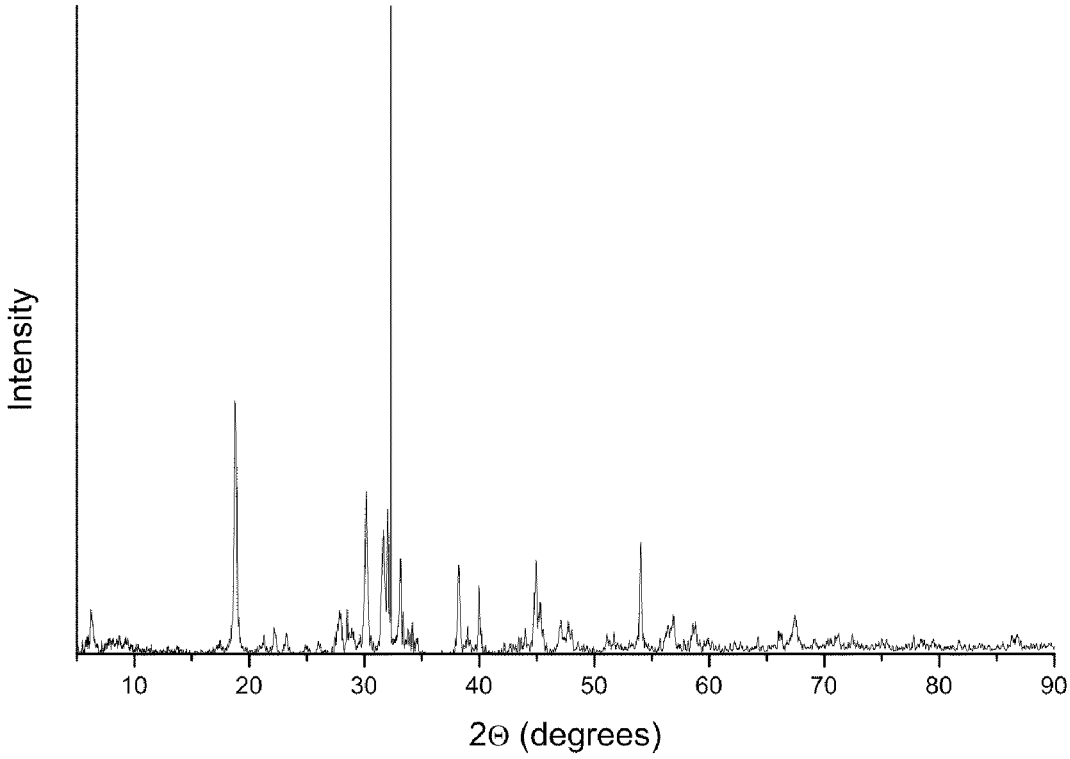
FIG. 7 provides an x-ray diffraction pattern of synthesized BNT powder (excellent match with JCPDS #43-0255 for BNT).

BNT powders, as well as other known compositions of this invention, can be synthesized using previously established wet chemical or solid state routes. For instance, BNT with barium carbonate, neodymium oxide, and titanium oxide as raw materials. The as-synthesized powder can be ball milled to tailor the particle size for plasma spray. (See FIG. 7.)

Example 7

Figure 8A:
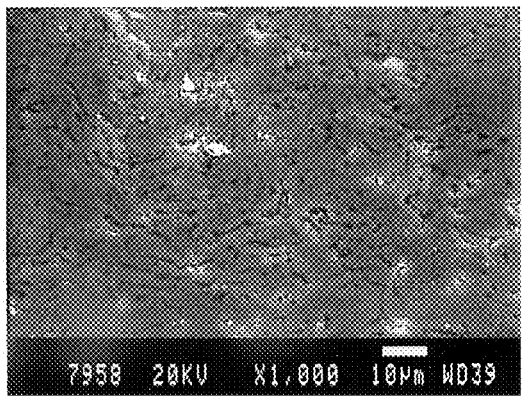
FIGS. 8*a* and 8*b* show Plasma Sprayed Spinel: a) free standing discs; b) SEM cross-section of the same.
Figure 8B:
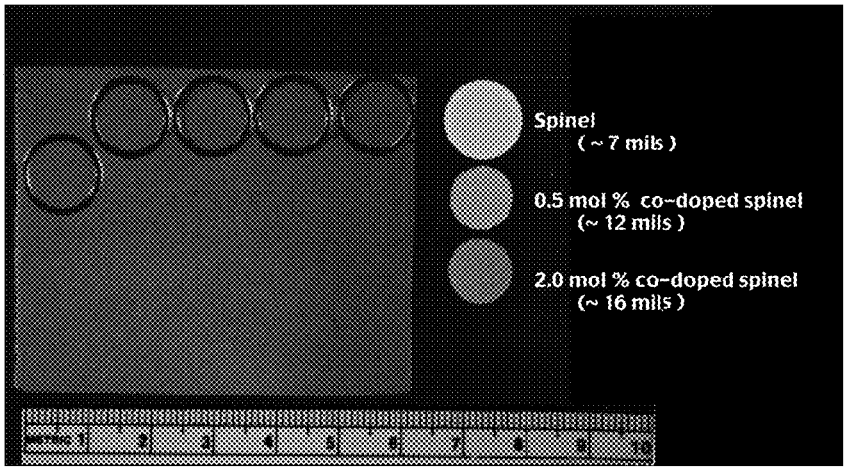

The plasma spray facilities of Northwestern University (Advanced Coating Technology Group or ACTG) were used to produce free-standing discs of spinel compounds having varying thickness (4-6 mils). This will allow for annealing the material to 1400 C and evaluate the microstructural and phase stability of the plasma sprayed material. A coating of aluminum is first applied on a steel substrate by plasma spray and then the ceramic is deposited on top. Circular sections (0.5 inch in diameter) of the coated specimen is core drilled using Northwestern University's sonic drill machine and then the aluminum is etched away to yield uniformly circular free standing discs (FIGS. 8*a* and 8*b*).

The same procedure described above can be used for BNT discs, to further evaluate material properties. For example, these discs can be annealed to 1400° C. to evaluate microstructure without concern about degradation of metal or bondcoat at these temperatures. In the composites of this invention, however, only the ceramic coating will be exposed to these high temperatures acting as a thermal barrier to protect the underlying substrate.

The BNT powder of Example 6 can be used to develop BNT coatings. The plasma spray parameters can be varied to obtain 3 different densities.

Example 8

Annealing of hot pressed BNT specimens and its effect on texture can be evaluated. The hot pressed material is sectioned and annealed to 1400° C. for various periods of time (10, 40, and 100 hours). The annealed specimens are then examined by SEM to evaluate grain growth, microcracking, and texture morphology.

Example 9

Figure 9:
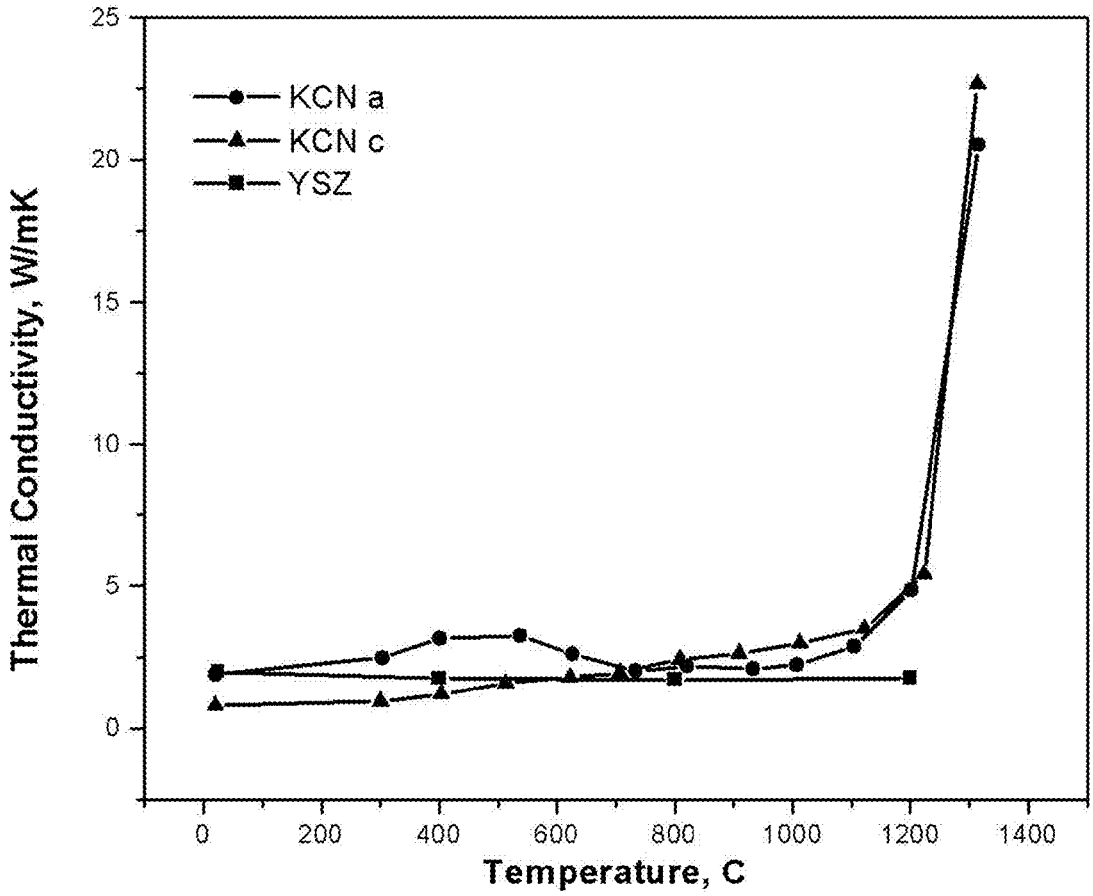
FIG. 9 shows the thermal conductivity behavior of hot pressed KCN and utility thereof under about 1200° C.

Potassium calcium niobate (KCN) was investigated to examine various high temperature properties. Its fracture behavior is unique and provides further evidence regarding the extent of crystalline anisotropy. Bulk specimens of textured KCN were prepared by standard hot pressing techniques, yielding a-direction and c-direction textured specimens for thermal conductivity measurements. The thermal conductivity (k value) in the c-direction was lower than that in the a-direction. Even though the material ultimately decomposed under test conditions, useful k values were measured at temperatures below 1200° C. (FIG. 9).

Example 10

Figure 10:
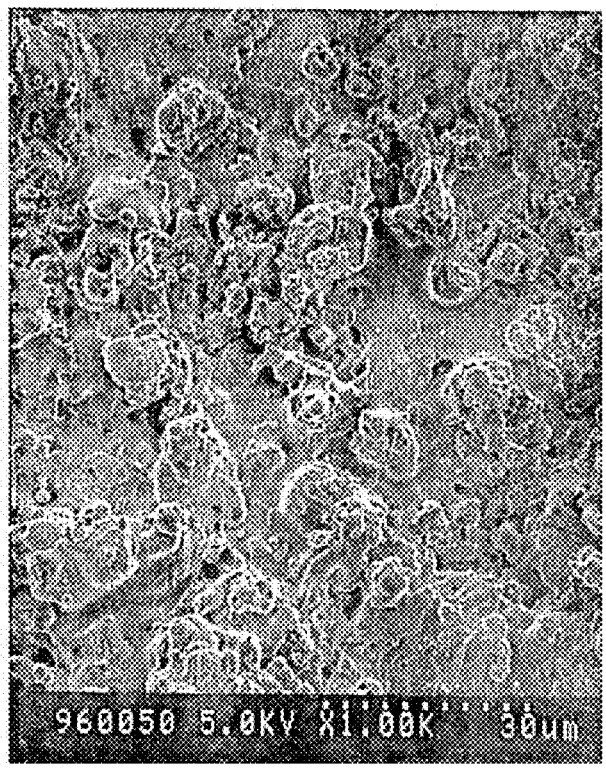
FIG. 10 shows (EDS pattern) the surface morphology of KCN deposited by plasma spray a technique of the prior art.
Figure 11:
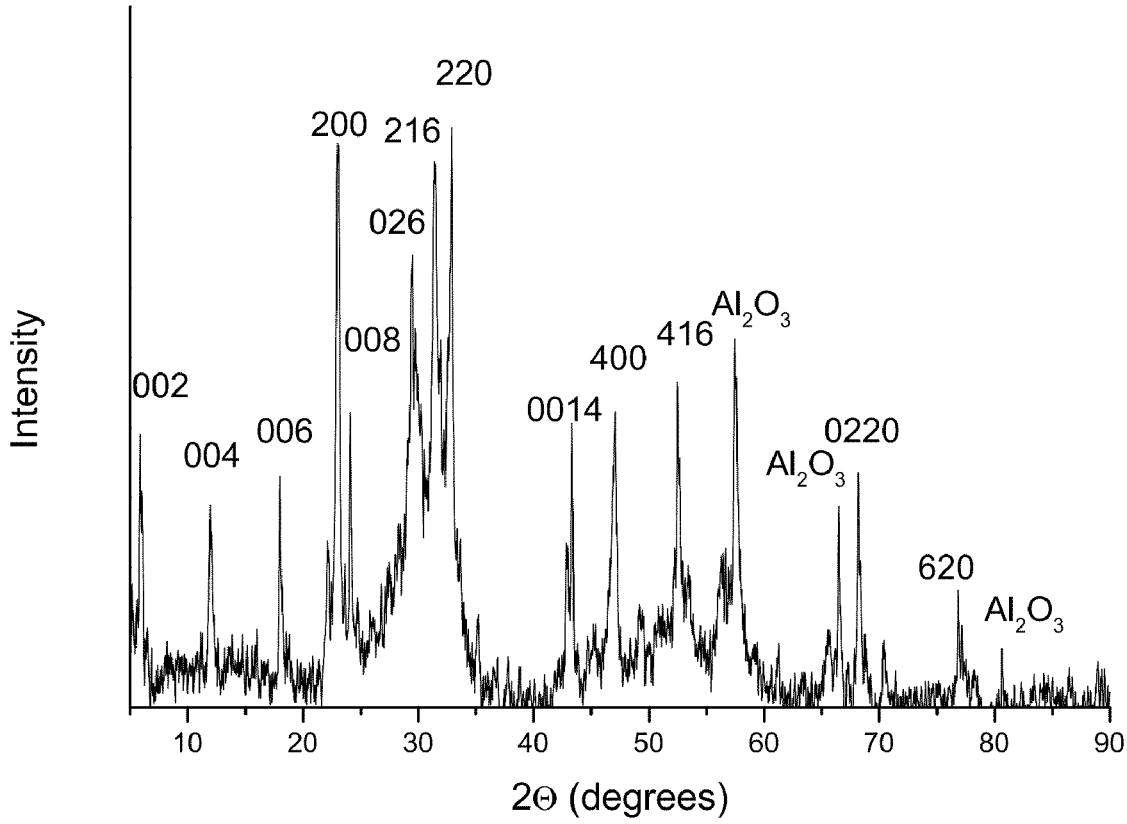
FIG. 11 is an XRD pattern of the KCN coating deposited as described in Example 10.

Various plasma spray techniques of the prior art can be used in conjunction with this invention. For instance, KCN was deposited on alumina substrates using the plasma spray techniques described in U.S. Pat. Nos. 5,744,777 and 5,858,470, each of which is incorporated herein by reference in its entirety. Such techniques can be modified as would be well-know to those skilled in the art for the deposition of any one of the ceramic materials described herein. FIG. 10 shows the surface morphology of the KCN coating obtained by the above-referenced technique. The coating appears to be dense, and the EDS and XRD pattern (FIG. 11) confirm the presence of KCN in the coating. The results of this example show the stability of such ceramic materials, as first subjected to high temperature plasma conditions, then as partially melted prior to substrate impact.

Example 11

Figure 12:
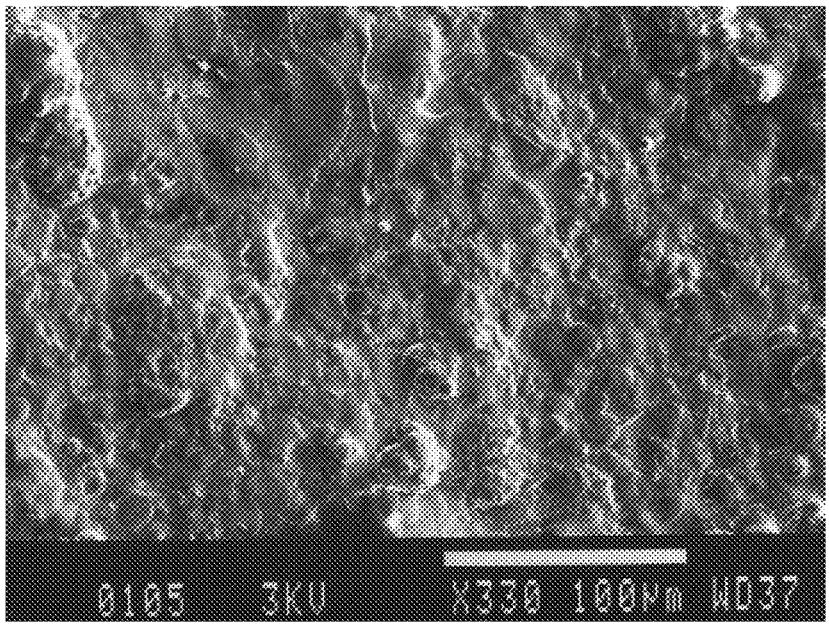
FIG. 12 is an SEM of a BNT coating deposited using a standard plasma spray technique.

BNT powder was synthesized through a solid state reaction of barium carbonate, neodymium oxide, and titanium dioxide. The powder was plasma sprayed using standard techniques onto steel coupons. The coating adheres well to the steel. The plasma spray parameters are shown in Table I. SEM investigation of the surface of these coating shows that the surface shows most of the BNT melted adequately in the plasma (FIG. 12). X-ray diffraction of the plasma sprayed BNT coating showed that BNT was present, and did not alter its phase or degrade during spraying.

TABLE I

| Plasma Spray parameters | |
|---|---|
| Powder feed rate | 1.1 rpm |
| Powder feeder gas flow (argon) | 0.25 psi |
| Plasma gun argon flow | 41 L/min |
| Plasma gun hydrogen flow | 8 L/min |
| Plasma gun current | 600 |
| Plasma torch | F4 |
| Plasma gun nozzle to electrode distance | 6 mm |
| Powder injector diameter | 2 mm |
| Powder injector angle | 90 |
| Powder injector distance to substrate | 5 mm |
| Plasma Current | 549 A |
| Plasma Voltage | 63.6 V |
| Plasma wattage | 35 kW |

Example 12

Figure 13:
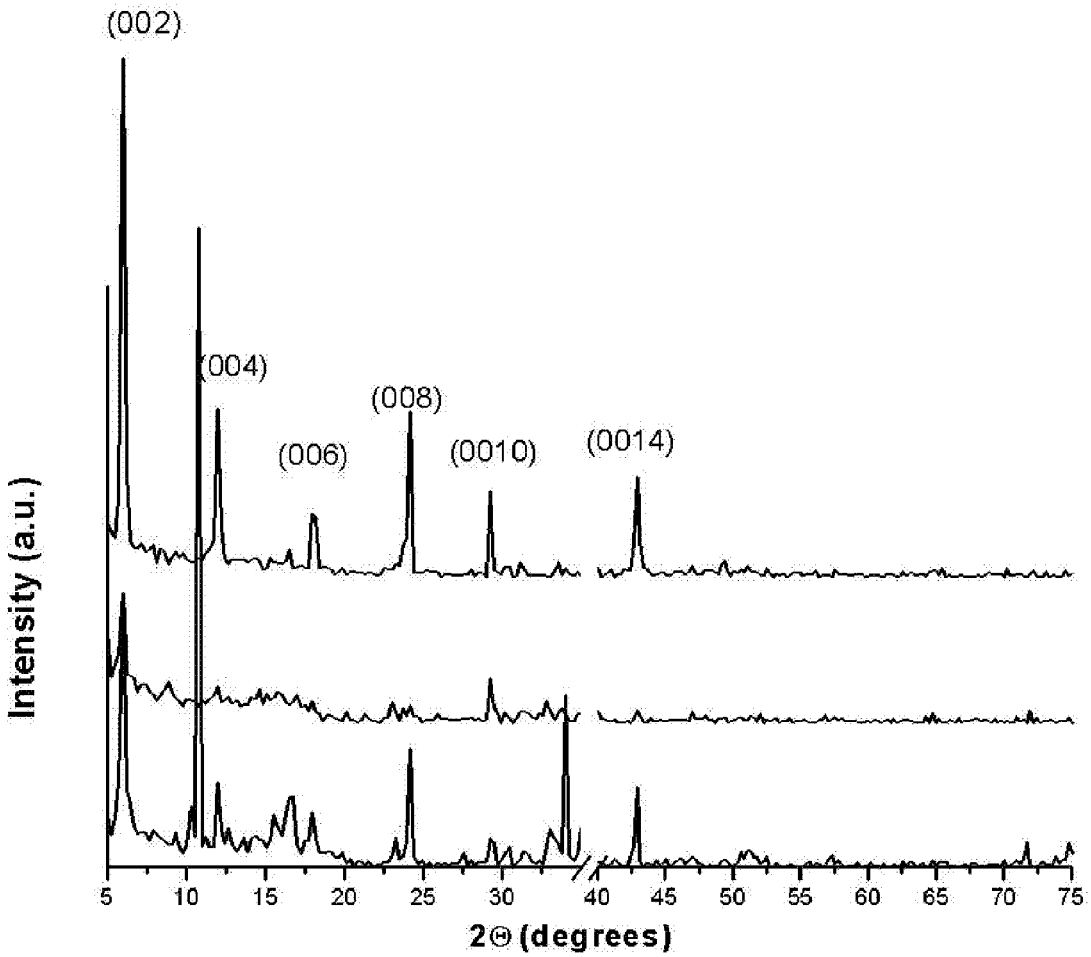
FIG. 13 shows a series of XRD patterns for the dip-coated KCN of Example 12, demonstrating texture change and/or control through different annealing conditions.

The composites of this invention can be prepared from standard solution deposition techniques. For instance, an ethanolic solution of niobium ethoxide, potassium ethoxide and calcium ethoxide produced stoichiometric KCN, for dip-coating a variety of suitable substrates. As demonstrated with solution deposition of KCN on sapphire, the coating texture (primarily c-direction or primarily a-direction) can be controlled by the annealing conditions (see, FIG. 13).

While the principles of this invention have been described in connection with specific embodiments, it should be understood clearly that these descriptions are added only by way of example and are not intended to limit, in any way, the scope of this invention. The present invention can be applied more specifically to the design of a barrier coating ceramic material with a texture tailored to optimize the thermal expansion to match an associated substrate. For instance, as most substrate alloys have a thermal expansion coefficient between about 11-13 ppm/° C., the corresponding barrier coating material can be designed to have a texture providing similar average thermal expansion. Other advantages, features, and benefits will become apparent from the claims hereinafter, with the scope of such claims determined by their reasonable equivalents, as would be understood by those skilled in the art.

What is claimed is:

1. A perovskite titanate composition containing $BaNb_2Ti_3O_{10}$ having an x-ray diffraction pattern as shown in FIG. 5*a* or FIG. 5*b*.

2. A metal substrate coated with the composition of claim 1.

3. A metal substrate of claim 2 coated by plasma spraying.

4. A coated substrate of claim 2 in which the metal is nickel, chromium, steel, yttrium or alloys thereof.

5. A coated substrate of claim 2 in which the perovskite titanate composition coating is a crystalline ceramic having crystalline anisotropy.

* * * * *

UNITED STATES PATENT AND TRADEMARK OFFICE

CERTIFICATE OF CORRECTION

PATENT NO. : 7,838,121 B1
APPLICATION NO. : 12/410080
DATED : November 23, 2010
INVENTOR(S) : Sambasivan et al.

It is certified that error appears in the above-identified patent and that said Letters Patent is hereby corrected as shown below:

Column 5, Line 53:

"7.10-066/K" should read --7.10-06/K--

Column 8, Line 58:

"11-13 ppm/°C.," should read --11-13 ppm/°C,--

Signed and Sealed this
Thirtieth Day of August, 2011

David J. Kappos

David J. Kappos
*Director of the United States Patent and Trademark Office*